United States Patent [19]

Teshima et al.

[11] Patent Number: 4,898,226

[45] Date of Patent: Feb. 6, 1990

[54] IMMERSION NOZZLE FOR CONTINUOUS CASTING OF STEEL

[75] Inventors: Toshio Teshima; Tooru Kitagawa; Mikio Suzuki; Toshi Masaoka; Takashi Mori; Kazutaka Okimoto, all of Tokyo, Japan

[73] Assignee: NKK Corporation, Tokyo, Japan

[21] Appl. No.: 199,018

[22] Filed: May 26, 1988

[30] Foreign Application Priority Data

Jun. 1, 1987 [JP] Japan ..... 62-134941
Feb. 25, 1988 [JP] Japan ..... 63-042720

[51] Int. Cl.[4] ..... B22D 11/10

[52] U.S. Cl. ..... 168/415; 164/437; 222/603

[58] Field of Search ..... 164/437, 438, 439, 415, 164/488, 489, 475, 337; 222/591, 603, 606, 607

[56] References Cited

U.S. PATENT DOCUMENTS 4,210,264 7/1980 Kondo ..... 222/591
4,588,112 5/1986 Kondo ..... 164/437

FOREIGN PATENT DOCUMENTS 62-130754 6/1987 Japan ..... 164/437
2081702A 8/1980 United Kingdom .
2081702B 10/1984 United Kingdom .

*Primary Examiner*—Richard K. Seidel
*Attorney, Agent, or Firm*—Frishauf, Holtz, Goodman & Woodward

[57] ABSTRACT

An immersion nozzle for continuous casting of molten steel comprises: an immersion nozzle body having a bore for introducing molten steel supplied from a tundish into a continuous casting mold; two exit ports located symmetrically about the vertical center axis of the immersion nozzle body at a lower portion of the immersion nozzle body for introducing the molten steel into the continuous casting mold; gas blow-in inlets in an inwall of the immersion nozzle body, the center axis line of the blow-in inlets crossing, at right angle, a vertical plane passing through a line connecting the respective centers of the exit ports; and gas blow conduits, each being connected respectively to one of the gas blow-in inlets. The gas blow-in inlets have a height almost equal to a vertical length across the exit ports, the top of the gas blow-in inlets being from 0 to 100 mm above the upper end of the exit ports.

6 Claims, 6 Drawing Sheets

IMMERSION NOZZLE FOR CONTINUOUS CASTING OF STEEL

BACKGROUND OF THE INVENTION

1. Field of the Invention

The present invention relates to an immersion nozzle for introducing molten steel from a tundish into a continuous casting mold, and more particularly to a structure of an immersion nozzle.

2. Description of the Prior Art

Deposits of oxide inclusion onto an inwall of an immersion nozzle increase in proportion to time lapse so much that the deposits not only restrict casting time but also builds a few microns of dioxide products contained in molten steel, resulting in often inducing defects of produced steel. This deposit of those inclusions is greatly affected by materials used in the immersion nozzle. For example, when an immersion nozzle is made of fused silica, there is almost no deposit of inclusions on the inwall of the immersion nozzle to be found. This immersion nozzle of fused silica, however, reacts with Mn or the like contained in the molten steel, and it is partially melted and damaged. Because of the melting loss, operating troubles may occur and the quality of cast steel products is unfavorably affected. In the ordinary case of casting aluminum killed steel, an immersion nozzle made of alumina graphite or of alumina graphite-zirconium is used. When an alumina graphite immersion nozzle is used, the deposit of oxide inclusions onto the nozzle inwall, sintering of the inclusions and growth thereof proceeds rapidly. Therefore, argon gas as an inert gas is blown in into the immersion nozzle to reduce the deposit of inclusion. Recently most immersion nozzles in use are made of zirconium because use thereof reduces the deposit of dioxide products.

FIGS. 1(*a*)–1(*c*) of the drawing show sectional views of an immersion nozzle of a first prior art apparatus. FIG. 1(*a*) is a sectional plan view of the immersion nozzle taken on line 2—2 of FIG. 1(*b*), passing through the respective centers of exit ports 12*a* and 12*b*. FIG. 1(*b*) is a vertical section of the immersion nozzle taken on line 3—3 of FIG. 1(*a*). FIG. 1(*c*) is a vertical section of the immersion nozzle taken on line 4—4 of FIG. 1(*c*). Immersion nozzle body 10 of the first prior art immersion nozzle has bore 14 for passing molten steel therein and is provided with two exit ports 12*a* and 12*b* located symmetrically about the vertical center axis of the immersion nozzle body at a lower portion thereof. The cross-sectional area of bore 14 is the same over the whole length of the immersion nozzle body. The horizontal inner length of exit portions 12*a* and 12*b* is the same as that of bore 14. The immersion nozzle body is made of alumina graphite or zirconium. Reference numeral 16 denotes inclusions, particularly alumina deposited on the inwall of the immersion nozzle body as schematically illustrated in the drawing. Because the alumina deposit often flakes or drops off into the molten steel, defects of cast steel products sometime occur. In addition, the alumina deposit reduces the section areas of the bore of the immersion nozzle and the exit ports of the immersion nozzle, and increases flow speed of the molten steel from the exit ports into the mold. As a result, the molten steel makes an active movement and the surface level up-and-down movement of the molten steel is increased. The molten steel flows into the strand, accompanying mold powders floating on the surface of the molten steel in the mold and due to this, this prior art apparatus is disadvantageous in causing defects of cast steel products attributable to the mold powder.

FIGS. 2(*a*)–2(*c*) shows sectional views of an immersion nozzle of a second prior art apparatus. FIG. 2(*a*) is a sectional plan view of the immersion nozzle taken on line 2—2 of FIG. 2(*b*), passing through the respective centers of exit ports 12*a* and 12*b*. FIG. 2(*b*) is a vertical section of the immersion nozzle taken on line 3—3 of FIG. 2(*a*). FIG. 2(*c*) is a vertical section of the immersion nozzle taken on line 4—4 of FIG. 2(*a*). In this second prior art apparatus, argon gas is blown in into the molten steel through slit nozzle 20 set into the bottom portion 18 of the immersion nozzle body 10. In order to reduce the thickness of alumina deposited on the inwall thereof, however, this prior art immersion nozzle is required to blow in a large amount of argon gas not only through slit nozzle 20 set in the bottom portion but also through the top of the immersion nozzle body. The total amount of argon gas blown in the immersion nozzle is 12–20 Nl/min wherein N refers to a condition of room temperature and atmospheric pressure. Due to increase of the argon gas blow-in amount the cast steel products are easy to have surface defects of slag inclusions and blow holes. The slag inclusions arise from the surface level movement of the molten steel in the mold caused by bubbles and the blow holes are caused by not only the increase of the actual amount of argon gas but also the growth of the bubbles.

SUMMARY OF THE INVENTION

It is an object of the present invention to provide an immersion nozzle for continuous casting enabling reducing alumina deposited on a nozzle and enabling the produced cast steel products to be free from surface defects of slag inclusions and blow holes.

To attain the object, in accordance with the present invention, an immersion nozzle for continuous casting of steel is provided, comprising: an immersion nozzle body having for introducing molten steel supplied from a tundish into a continuous casting mold; two exit ports located symmetrically about the vertical center axis of said immersion nozzle at a lower inwall portion of said immersion nozzle body to introduce the molten steel into the continuous casting mold; gas blow-in inlets arranged in an inwall of said immersion nozzle body, a center axis line of said gas blow-in inlets crossing, substantially at right angles, a vertical plane passing through a line connecting respective centers of said exit ports; and gas flow conduits, each being connected respectively to said gas blow-in inlets.

The above object and other object and advantages of the present invention will become apparent from the detailed description to follow, taken in conjunction with the appended drawings.

DESCRIPTION OF THE PREFERRED EMBODIMENT

Figure 1:
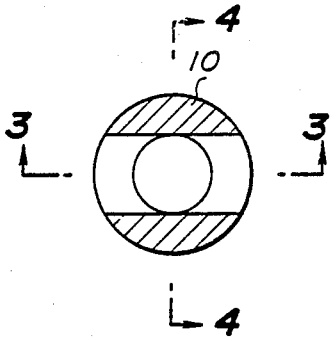
FIG. 1 (a) (Prior Art)
FIGS. 1 (*a*)–1(*c*) show sectional views of a first prior art immersion nozzle.
Figure 1:
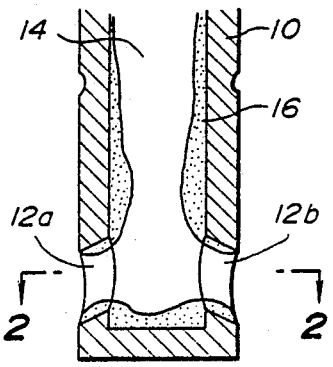
FIG. 1 (b) (Prior Art)
Figure 1:
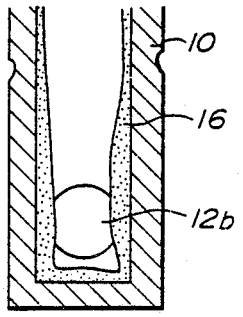
FIG. 1 (c) (Prior Art)

Using an immersion nozzle of the first prior art device shown in FIGS. 1 (*a*)-1(*c*) the inventors pursued relations of casting time to thickness of alumina deposited on an inwall of the immersion nozzle, flow speed of molten steel in the immersion nozzle to the thickness of the alumina deposit and argon gas blow-in in amount to the thickness of the alumina deposit. The following results were recognized.

(A) In the direction of the vertical section of the immersion nozzle taken on line 3—3 of FIG. 1(*a*), (in the direction of a line passing through the respective centers of exit ports 12*a* and 12*b*), the thickness of alumina deposit is decreased by changing the material of the immersion nozzle from alumina-graphite to zirconium, by increasing the amount of argon gas blown in the immersion nozzle body.

(B) In the direction of the vertical section of immersion nozzle taken on line 4—4 of FIG. 1(*a*) (in the direction of the vertical section crossing, at right angles, a horizontal line connecting the centers of exit ports 12*a* and 12*b*), the thickness of the alumina deposit is not decreased because the molten steel flows stagnantly even if the material of the immersion nozzle is changed from alumina-graphite into zirconium, the flow speed of the molten steel is increased inside the immersion nozzle and the amount of argon gas blown in is increased.

Based on the above-mentioned knowledge, it has become clear that if measures such as increase of flow speed of stagnate molten steel in the direction of the vertical section, or stirring and cleaning gas existing along the inwall are taken, the thickness of the alumina deposited in the direction of the vertical section of the immersion nozzle of the first prior art of FIGS. 1(*a*-)-1(*c*) taken on line 4—4 of FIG. 1(*a*) can be decreased as that in the direction of the vertical section taken on 3—3 of FIG. 1(*a*).

With specific reference to the appended drawings, an immersion nozzle of an embodiment of the present invention will now be described.

Figure 3:
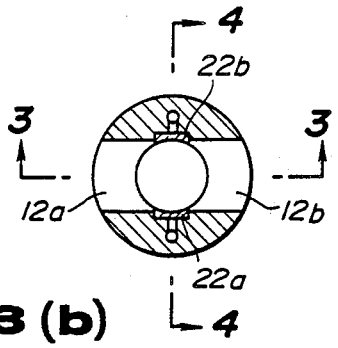
FIGS. 3(*a*)–3(*c*) show sectional views of a preferred embodiment of an immersion nozzle ,according to the present invention.
Figure 3:
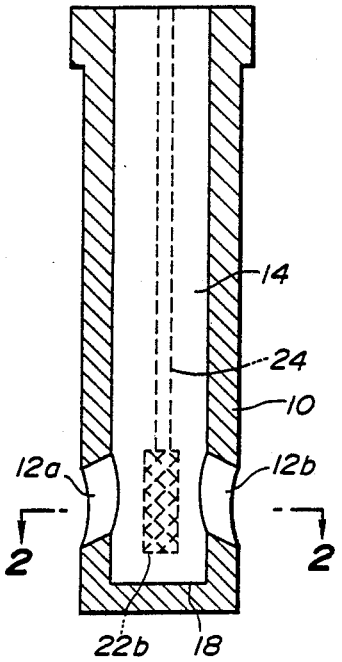
Figure 3:
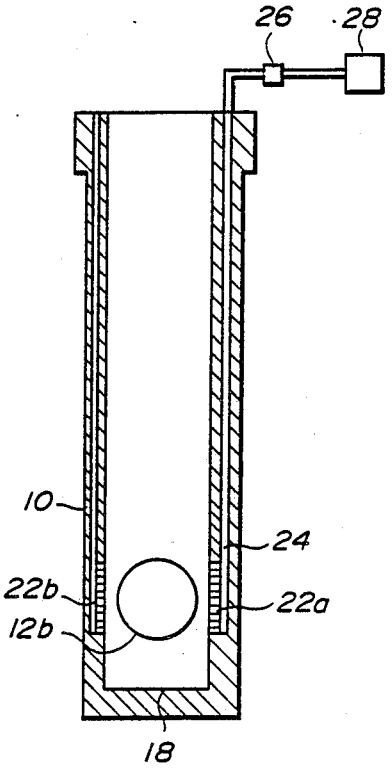

FIGS. 3(*a*)-3(*c*) show sectional views of an embodiment of an immersion nozzle of the present invention. FIG. 3 (*a*) is a sectional plan view of the immersion nozzle taken on line 2—2 passing through the centers of exit ports 12*a* and 12*b*. FIG. 1(*b*) is a vertical view of the immersion nozzle taken on line 3—3 of FIG. 3(*a*). FIG. 3(*c*) is a vertical view of the immersion nozzle taken on line 4—4 of FIG. 3(*a*).

Immersion nozzle body 10 of the immersion nozzle is made of refractory material. Bottom 18 of the immersion nozzle body is of a pool shape. At a lower portion of the immersion nozzle body, two exit ports 12*a* and 12*b* are located symmetrically about the vertical center axis of the immersion nozzle and gas blow-in inlets 22*a* and 22*b* are arranged such that the center axis line of the gas blow-in inlet crosses, at right angles, a vertical plane passing through the line connecting each of the centers of the exit ports. Argon gas is introduced from gas supply means 28 through gas supply joint pipe 26 into gas flow conduit 24, and is further transferred to gas blow-in inlets 22*a* and 22*b*.

Refractory materials used for immersion nozzle body 10 can be any one of a alumina graphite, zirconium, and alumina graphite-zirconium. Gas blow-in inlets 22*a* and 22*b* are formed from a porous plug or multiple fine holes. Argon gas of 1.0 to 2.0 Nl/min. is blown in. If the gas amount is less than 1.0 Nl/min., cleaning capability is decreased and this results in inducing deposits of alumina. Contrarily, if it is over 2.0 Nl/min., flow of molten steel is disturbed and surface defects attributable to mold powders are produced.

Argon gas is blow-in not only through gas blow-in inlets 22*a* and 22*b* but also through a tundish nozzle set in at an upper portion of the immersion nozzle (not shown) so as to restrain alumina deposited on an inwall from a tundish outlet to an upper portion of the immersion nozzle body. The amount of argon gas to be blown in through gas blow-in inlets 22*a* and 22*b* and the tundish outlet ranges preferably from 5 to 10 Nl/min. If the argon gas amount is less than 5 Nl/min., alumina deposits on the inwall of the immersion nozzle body, while if it is over 10 Nl/min., blow holes on the surface of cast steel products increase in number.

In this embodiment, a sectional area of a bore for passing the molten steel is equal, over the whole length of the immersion nozzle body, but the sectional area is not necessarily limited to the terms of the equality. A sectional area at the exit ports and therebelow can be smaller than that above the exit ports. Due to this area constitution, the stagnate flow of the molten steel in the immersion nozzle body disappears. A ratio of a sectional area (A) of the bore at the exit ports and therebelow to a sectional area (B) above the exit ports, i.e., a reduction (A)/(B) ranges preferably from 0.05 to 0.8. If the reduction ratio is less than 0.5, solidified metal stops below the exit ports at the initial stage of casting. If it is over 0.8, the alumina deposit increases.

EXAMPLE-1

An immersion nozzle used in this example had gas blow-in inlets 22*a* and 22*b* of 30 mm in width and 100 mm in height, and the top end of the gas blow-in inlets and the top end of exit ports 12*a* and 12*b* for introducing molten steel into a mold were of an equal level. Exit ports 12*a* and 12*b*, each, had a diameter of 80 mm.

Figure 2A:
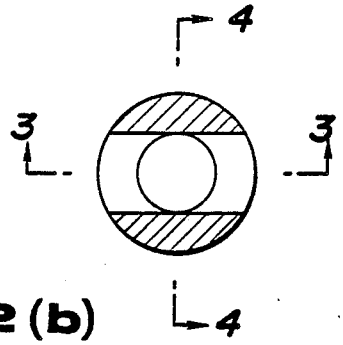
FIG. 2(a) (Prior Art)
FIGS. 2 (*a*)–2(*c*) show sectional views of a second prior art immersion nozzle.
Figure 2B:
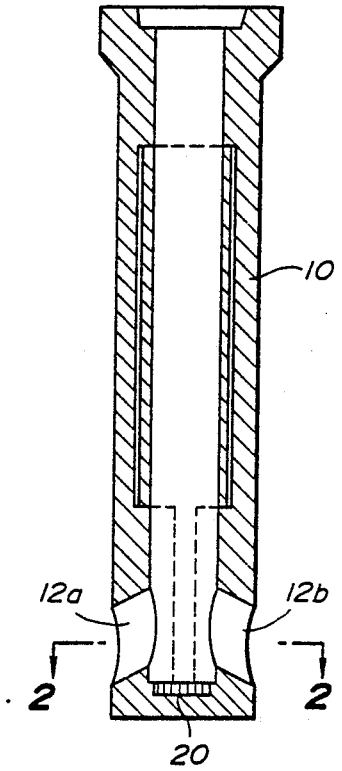
FIG. 2(b) (Prior Art)
Figure 2C:
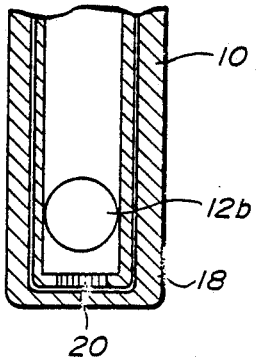
FIG. 2(c) (Prior Art)

Firstly, the molten steel was supplied from a tundish (not shown) into the immersion nozzle, and was introduced into a continuous casting mold (not shown) through exit ports 12*a* and 12*b* facing each other. Argon gas was sent to gas blow-in inlets 22*a* and 22*b* at a rate of 2 Nl/min. through gas supply joint pipe 26 and gas flow conduit 24 by means of gas supply means 28. The argon gas was blown in a state of bubbling into the molten steel in the immersion nozzle. In addition to the blow-in through the gas blow-in inlets, argon gas was also blown in at a flow rate of 3 to 8 Nl/min. through a tundish insert nozzle (not shown) to reduce increase of thickness of alumina deposit from a tundish outlet to an upper inwall portion of the immersion nozzle. The total amount of argon gas blow-in to the molten steel was 5 to 10 Nl/min. There was no increase of a number of blow holes on the surface of cast steel products and what is more, the deposit of inclusions to the vicinity of gas blow-in inlets 12 could be reduced. Regarding the alumina deposit thickness and the number of blow holes on the surface of cast slabs, comparison of the results of Example 1 of the present invention with those of the first prior art of FIGS. 1(*a*)–1(*c*) of blowing in argon gas through the upper side of an immersion nozzle and those of the second prior art of FIGS. 2(*a*)–2(*c*) of gas parallely through both of the upper and lower side of an immersion nozzle are listed below in Table 1.

TABLE 1

| | Alumina deposit (mm) | Blow Holes (pieces/m$^2$) |
|---|---|---|
| Example-1 | 1–7 | 2 or less |
| Prior Art-1 | 12–21 | 2 or less |
| Prior Art-2 | 1–8 | 2–8 |

The alumina deposit of Example-1 was reduced to one third of that of the first prior art in thickness. The blow holes produced on the surface of the slabs in the case of Example-1 were remarkably decreased in comparison with those of the second prior art. When an immersion nozzle of the present invention was used, good marks were obtained with respect to the alumina deposit and blow hole appearance.

EXAMPLE-2

In this example, relation of glass blow-in levels to the alumina deposit thickness was checked by means of changing levels of the gas blow-in. A distance from the upper end of exit port 12 on the molten steel entry side to the top of gas blow-in inlet 22 was varied within a range of −30 to 150 mm in an ascending direction.

Figures 4A, 4B, 4C, 4D, 4E:
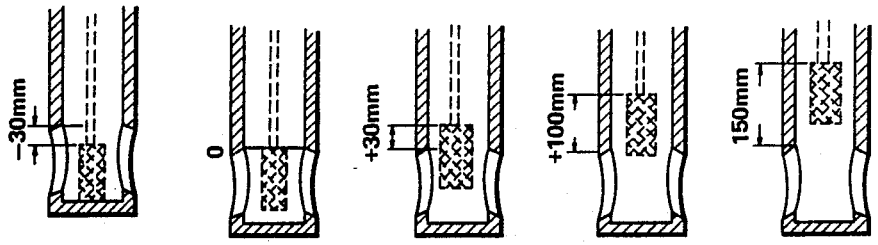
FIG. 4(*a*)–4(*c*) show schematic views illustrating gas blow-in inlets having various blow-in levels.

FIGS. 4(*a*)–4(*e*) schematically illustrate levels of gas blow-in inlets. FIG. 4(*a*) shows a level where the top of gas blow-in inlet 22 is arranged 30 mm below the upper end of exit port 12. FIG. 4(*b*) is a view showing a level of the top of the gas blow-in inlet arranged at the same level of the upper end of the exit port. FIG. 4(*c*) is a view showing a level of the top of the gas blow-in inlet arranged 30 mm above the upper end of the exit port. FIG. 4(*d*) is a view of a level of the top of the gas blow-in inlet 100 mm high from the upper end of the exit port. FIG. 4(*e*) is a view of a level of the top of the gas blow-in inlet 150 mm high from the upper end of the exit port.

Figure 5:
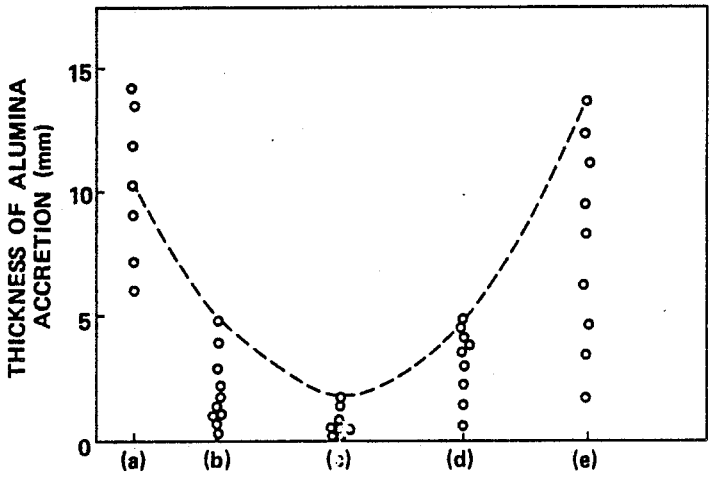
FIG. 5 is a graphic representation showing relation of gas blow-in levels shown in FIG. 4 to thickness of alumina deposit.

FIG. 5 graphically shows relation of levels of gas blow-in shown in FIGS. 4(*a*)–4(*e*) to alumina deposit thickness. As clearly seen from the graphic representation, the alumina deposit thickness is thin when the level of the top of the gas blow-in inlet ranges 0 to 100 mm above the upper end of the exit port on the molten steel entry side. Moreover, the thickness is thinner when the level of the top of the gas blow-in inlet is 10 to 50 mm above the upper end of the exit port. Consequently, it is preferable that the level of the top of the gas blow-in inlet ranges 0 to 100 mm above the upper end of the exit port on the molten steel entry side. The level range of 10 to 50 mm above is more preferable.

Figure 6C:
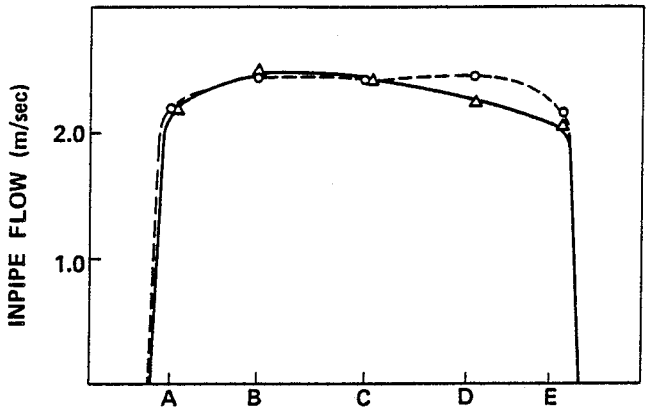
FIG. 6(*a*)-6(*c*) are graphic representation showing distribution of in-pipe flow speed of molten steel, depending on measurement levels of gas blow-in when an immersion nozzle of the first prior art is used.
Figure 6B:
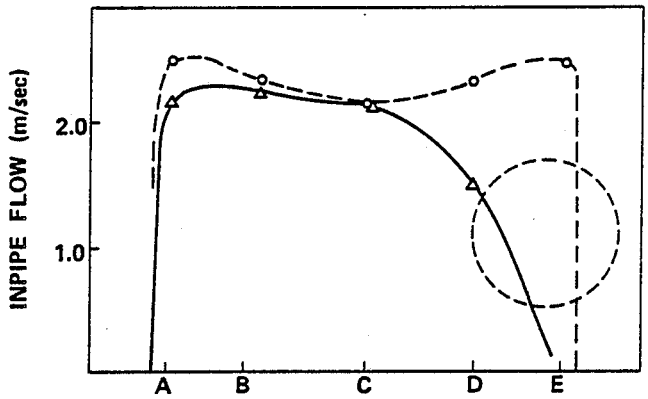
Figure 6A:
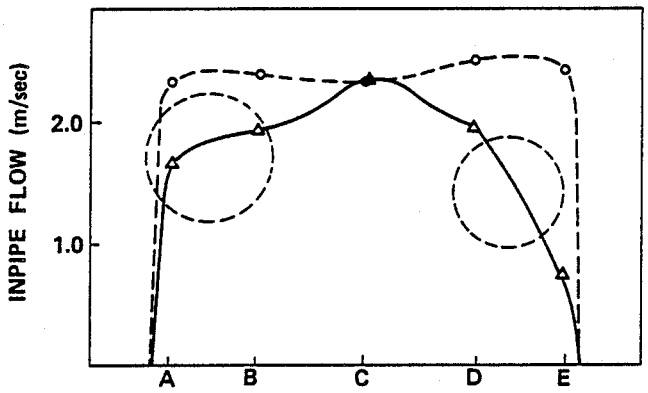

The reason for preferring the above ranges will be described with specific reference to FIGS. 6(*a*)–(*c*). FIGS. 6(*a*)–6(*c*) graphically represents distributions of flow speed of molten steel in the immersion nozzle. FIG. 6(*a*) shows a flow speed of molten steel at the level of the upper end of exit port 12 when an immersion nozzle of the first prior art of FIGS. 1(*a*)–1(*c*) was used. Symbol "○" indicates a flow speed, in the direction of the immersion nozzle taken on line 3—3 of FIG. 1(*a*), and symbol "Δ" a flow speed in the direction on 1(*a*). Flow speed of molten steel in the immersion nozzle was measured at the points of A, B, C, D and E. A and E were at the vicinity of the nozzle inwall, C at the central part, and B and D between the vicinity of the nozzle inwall and the central part. FIG. 6(*b*) shows a flow speed of molten steel at the level of 30 mm above the upper end of exit port 12 for introducing molten steel into a mold. FIG. 6(*c*) shows a flow speed of molten at the level of 150 mm above the upper end of exit port 12. As clearly recognized from this graphic representation, the flow speed in the direction of line 3—3 of FIG. 1(*a*) are almost constant at either of levels 30 mm and 150 mm above the upper end of exit port. The distribution of the flow speed in the direction the immersion nozzle taken on line 4—4 shows partially a distribution having speed reduction area (the portion of the stagnation of the flow) as illustrated by the dotted lines at the levels of 30 or 150 mm above the upper end of the exit ports. This flow speed reduction area appears remarkably at the level of 30 mm or below the upper end of the exit port. At the level of over 30 mm, the flow speed shows a uniform distribution having no speed reduction area as shown in FIG. 6(*c*). Accordingly, it is suitable for reducing alumina deposits to clean, by gas injection, the stagnant area where the speed reduction occurs. Namely, the alumina deposit thickness is reduced when the top of the gas blow-in inlet is arranged at the level of 0 to 100 mm above the upper end of the exit port on the molten steel entry side. The thickness of alumina deposit according to the present invention was reduced to one third to one fifth of that formed before this improvement.

EXAMPLE-3

Figure 7:
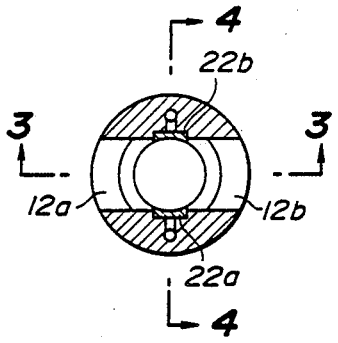
FIG. 7 shows sectional views of an immersion nozzle used in Example 3 according to the present invention.
Figure 7:
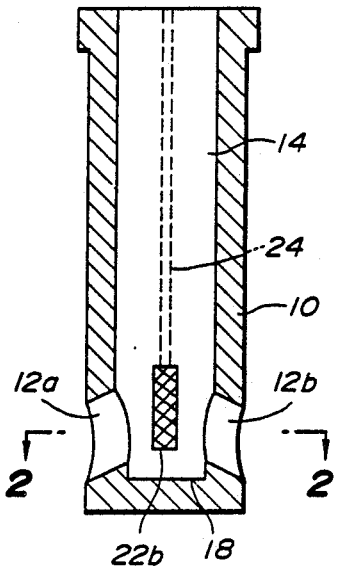
Figure 7:
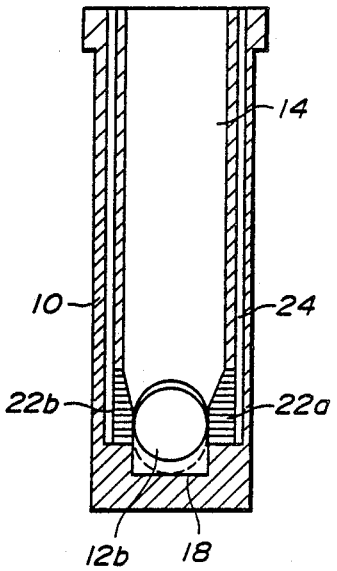

This is an example of an immersion nozzle wherein a sectional area of a bore of the immersion nozzle body at an inwall portion of exit port 12 and therebelow is smaller than a sectional area of the bore of the immersion nozzle body at an inwall portion above the exit port. FIG. 7(*a*) is a sectional plan view of an immersion nozzle of the present invention taken on line 2—2 of FIG. 7(*b*). FIG. 7(*b*) is a vertical view of the immersion nozzle taken on line 3—3 of FIG. 7(*a*). FIG. 7(*c*) is a vertical view of the immersion nozzle taken on line 4—4 of FIG. 7(*a*). The sectional area of the bore at the inwall portion of the exit port and therebelow was designed to be of 60% of that above the exit port. The top of the gas blow-in inlet was set at a level of 30 mm above the exit port.

Argon gas was blown in at a flow rate of 2.0 Nl/min. through gas blow-in inlets 22*a* and 22*b*. Through tundish nozzles, argon gas was also blown in at a flow rate of 3 to 8 Nl/min. to reduce the thickness of alumina deposited from tundish outlets onto an upper inwall portion of the immersion nozzle. In this example, the thickness of the alumina deposit was reduced by 50%, in comparison with that of Example-1.

What is claimed is:

1. An immersion nozzle for continuous casting of steel, comprising:

an immersion nozzle body having a bore for introducing molten steel supplied from a tundish into a continuous casting mold;

two exit ports located symmetrically about the vertical center axis of said immersion nozzle body at a lower portion of said immersion nozzle body to introduce the molten steel into the continuous casting mold;

gas blow-in inlets in an inwall of said immersion nozzle body, a center axis line of the gas blow-in inlets crossing, substantially at a right angle, a vertical plane passing through a line connecting the respective centers of the two exit ports;

said gas blow-in inlets have a height substantially equal to a vertical diameter across said exit ports, the top of said gas blow-in inlets being from 0 to 100 mm above the upper end of said exit ports in an inwall of said immersion nozzle body; and gas blow conduits, each being connected respectively to one of said gas blow-in inlets.

2. The immersion nozzle according to claim 1, wherein the top of said gas blow-in inlets are from 10 to 50 mm above the upper end of said exit ports in an inwall of said immersion nozzle.

3. The immersion nozzle according to claim 1, wherein said gas blow-in inlets include a gas blow-in inlet through which argon gas is blown in at a rate of 1.0 to 2.0 Nl/min.

4. The immersion nozzle according to claim 1, wherein said gas blow-in inlets are formed from a porous plug.

5. The immersion nozzle according to claim 1, wherein said immersion nozzle body is made of any one of the materials selected from the group consisting of alumina graphite, zirconium and alumina graphite-zirconium.

6. The immersion nozzle according to claim 1, wherein said gas flow conduits are built in an inwall portion of said immersion nozzle body.

* * * * *